US010830495B2

(12) United States Patent
Tsai et al.

(10) Patent No.: US 10,830,495 B2
(45) Date of Patent: Nov. 10, 2020

(54) WATER HEATER APPLIANCE AND A METHOD FOR OPERATING A WATER HEATER APPLIANCE

(71) Applicant: Haier US Appliance Solutions, Inc., Wilmington, DE (US)

(72) Inventors: Craig Iung-Pei Tsai, Louisville, KY (US); Alan George Constance, Jeffersonville, IN (US); Jonathan D. Nelson, Louisville, KY (US); Patrick Cox, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 122 days.

(21) Appl. No.: 16/056,589

(22) Filed: Aug. 7, 2018

(65) Prior Publication Data

US 2020/0049377 A1 Feb. 13, 2020

(51) Int. Cl.

| | |
|---|---|
| ***F24H 9/20*** | (2006.01) |
| ***F24H 1/20*** | (2006.01) |
| ***F24H 9/18*** | (2006.01) |

(52) U.S. Cl.

CPC ..... *F24H 9/2035* (2013.01); *F24H 1/206* (2013.01); *F24H 9/1836* (2013.01)

(58) Field of Classification Search

CPC . F22B 1/28; F24H 9/20; F24H 9/2007; F24H 1/185; F24H 1/20; F24H 1/0018

See application file for complete search history.

(56) References Cited

U.S. PATENT DOCUMENTS

| | | | | |
|---|---|---|---|---|
| 1,892,557 | A | 12/1932 | McCormick | |
| 6,374,046 | B1 * | 4/2002 | Bradenbaugh | F24H 9/2021 219/492 |
| 7,117,825 | B2 * | 10/2006 | Phillips | F24H 9/2021 122/4 A |
| 7,603,204 | B2 * | 10/2009 | Patterson | G01K 7/42 219/497 |
| 8,061,308 | B2 * | 11/2011 | Phillips | F24H 9/2021 122/14.2 |
| 8,983,283 | B2 * | 3/2015 | Miu | F24H 9/2021 219/483 |
| 10,378,791 | B2 * | 8/2019 | Hinton | F24H 1/202 |
| 2006/0013572 | A1 * | 1/2006 | Phillips | F24H 9/2021 392/459 |

(Continued)

*Primary Examiner* — Gregory A Wilson

(74) *Attorney, Agent, or Firm* — Dority & Manning, P.A.

(57) ABSTRACT

A method for operating a water heater appliance includes determining a set temperature of the water heater appliance. The method also includes monitoring a temperature proximate to a lower heating element of the water heater appliance with a first temperature sensor of the water heater appliance and monitoring a temperature proximate to an upper heating element of the water heater appliance with a second temperature sensor of the water heater appliance. When the monitored temperature proximate the lower heating element is less than a first temperature threshold and the monitored temperature proximate the upper heating element is less than a second temperature threshold, the method includes turning the lower heating element on. When the monitored temperature proximate the upper heating element is equal to the set temperature, the method includes turning the lower heating element off. A related water heater appliance is also provided.

15 Claims, 3 Drawing Sheets

(56) References Cited

U.S. PATENT DOCUMENTS

| | | | | |
|---|---|---|---|---|
| 2006/0047870 | A1* | 3/2006 | Phillips | F24H 9/2021 710/72 |
| 2007/0175883 | A1* | 8/2007 | Miu | F24H 9/2021 219/400 |

* cited by examiner

WATER HEATER APPLIANCE AND A METHOD FOR OPERATING A WATER HEATER APPLIANCE

FIELD OF THE INVENTION

The present subject matter relates generally to water heater appliances and related methods of operating such water heater appliances.

BACKGROUND OF THE INVENTION

Water heater appliances generally operate to heat water within tanks of the water heater appliances to a predetermined set temperature. Various heating elements are available to heat water within water heater appliances. For example, electric water heaters utilize electric heating elements to heat water, gas water heaters utilize gas burners to heat water, and heat pump water heaters utilize a sealed heat pump system to heat water.

Generally, water heater appliances include at least an upper heating element near the top of the tank, and a lower heating element near the bottom of the tank. Hotter water within the tank will rise to the top of the tank, accordingly, a hot water outlet is usually positioned at or near the top of the tank. When hot water is drawn from the outlet at the top of the tank, cold water is supplied to the tank at or near the bottom of the tank. The water may then be heated by activating one of the lower heating element and the upper heating element. Generally, only one of the lower heating element and the upper heating element will be activated at a time, such that while both the upper heating element and the lower heating element may be activated in response to a given draw, the upper heating element and the lower heating element would be activated alternately.

A first temperature sensor is usually associated with the lower heating element and a second temperature sensor is usually associated with the upper heating element. For example, the first temperature sensor is usually positioned near the lower heating element and the lower heating element is generally activated or deactivated based on a temperature sensed by the first temperature sensor. Thus, when cold water enters the bottom of the tank, the first temperature sensor will sense the cold temperature before the second temperature sensor. As a result, the lower heating element is typically the first to activate after a hot water draw from the tank, and, in at least some cases, such as a relatively small draw (e.g., a small volume of hot water is drawn as compared to the overall volume of the tank), the lower heating element may be the only heating element of the lower heating element and the upper heating element to be activated. Thus, in many draws from the water heater, the upper heating element will be activated only after a delay, if at all.

However, if the upper heating element is not activated, then the second temperature sensor will not provide any input into activation/deactivation of the heating elements, as the lower heating element is only controlled by the first temperature sensor. Each time the lower heating element is activated, the heated water then rises to the top of the tank, where the maximum temperature in the tank will not be sensed by the first temperature sensor. Accordingly, in a subsequent draw, the lower heating element will be activated based on the temperature sensed by the first temperature and without regard to the temperature at the top of the tank as sensed by the second temperature sensor, and the resulting heated water will again rise to the top of the tank. When a series of short draws occurs in a short period of time, thermal stacking can occur at the top of the tank, where repeated activation of the lower heating element causes heated water to accumulate at the top of the tank until the temperature of water at the top of the tank may exceed the set temperature.

Accordingly, methods for operating a water heater appliance that reduce or avoid thermal stacking while maximizing first hour delivery and recovery through appropriate activation of the available heat sources would be useful.

BRIEF DESCRIPTION OF THE INVENTION

Aspects and advantages of the invention will be set forth in part in the following description, or may be apparent from the description, or may be learned through practice of the invention.

In a first exemplary embodiment, a method for operating a water heater appliance is provided. The method includes determining a set temperature of the water heater appliance. The method also includes monitoring a temperature proximate to a lower heating element of the water heater appliance with a first temperature sensor of the water heater appliance and monitoring a temperature proximate to an upper heating element of the water heater appliance with a second temperature sensor of the water heater appliance. When the monitored temperature proximate the lower heating element is less than a first temperature threshold and the monitored temperature proximate the upper heating element is less than a second temperature threshold, the method includes turning the lower heating element on. When the monitored temperature proximate the upper heating element is equal to the set temperature, the method includes turning the lower heating element off.

In a second exemplary embodiment, a water heater appliance is provided. The water heater appliance includes a tank that extends between a top portion and a bottom portion along a vertical direction. The tank also defines an interior volume. The water heater appliance also includes an upper heating element positioned within the interior volume of the tank proximate the top portion of the tank and a lower heating element positioned within the interior volume of the tank proximate the bottom portion of the tank. A first temperature sensor is positioned proximate the lower heating element and configured for measuring a temperature of water within the interior volume of the tank proximate the lower heating element. A second temperature sensor is positioned proximate the upper heating element and configured for measuring a temperature of water within the interior volume of the tank proximate the upper heating element. The water heater appliance also includes a controller. The controller is configured for monitoring the temperature proximate to the lower heating element of the water heater appliance with the first temperature sensor and monitoring the temperature proximate to the upper heating element of the water heater appliance with the second temperature sensor. The controller is further configured for turning the lower heating element on when the monitored temperature proximate the lower heating element is less than a first temperature threshold and the monitored temperature proximate the upper heating element is less than a second temperature threshold. The controller is also configured for turning the lower heating element off when the monitored temperature proximate the upper heating element is equal to the set temperature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
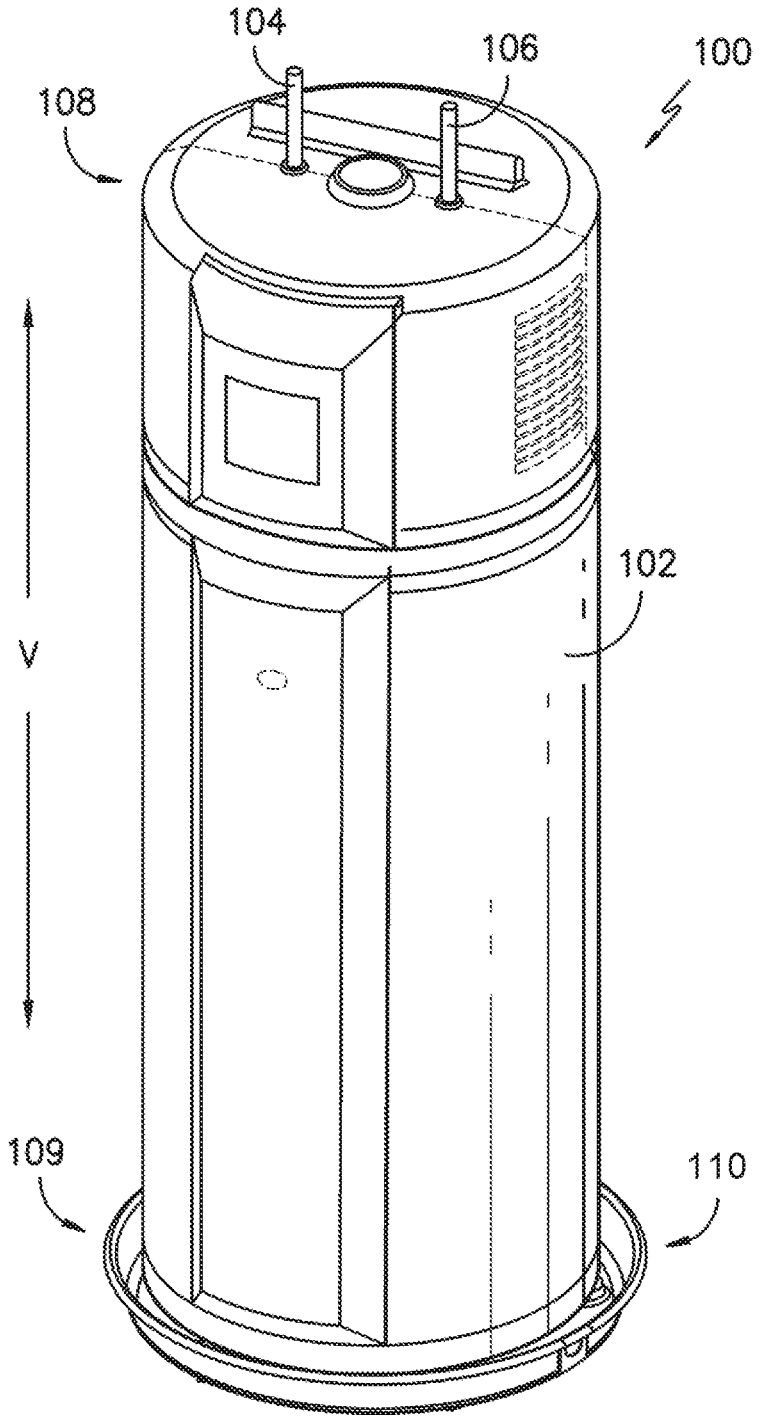
FIG. 1 provides a perspective view of a water heater appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows. As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
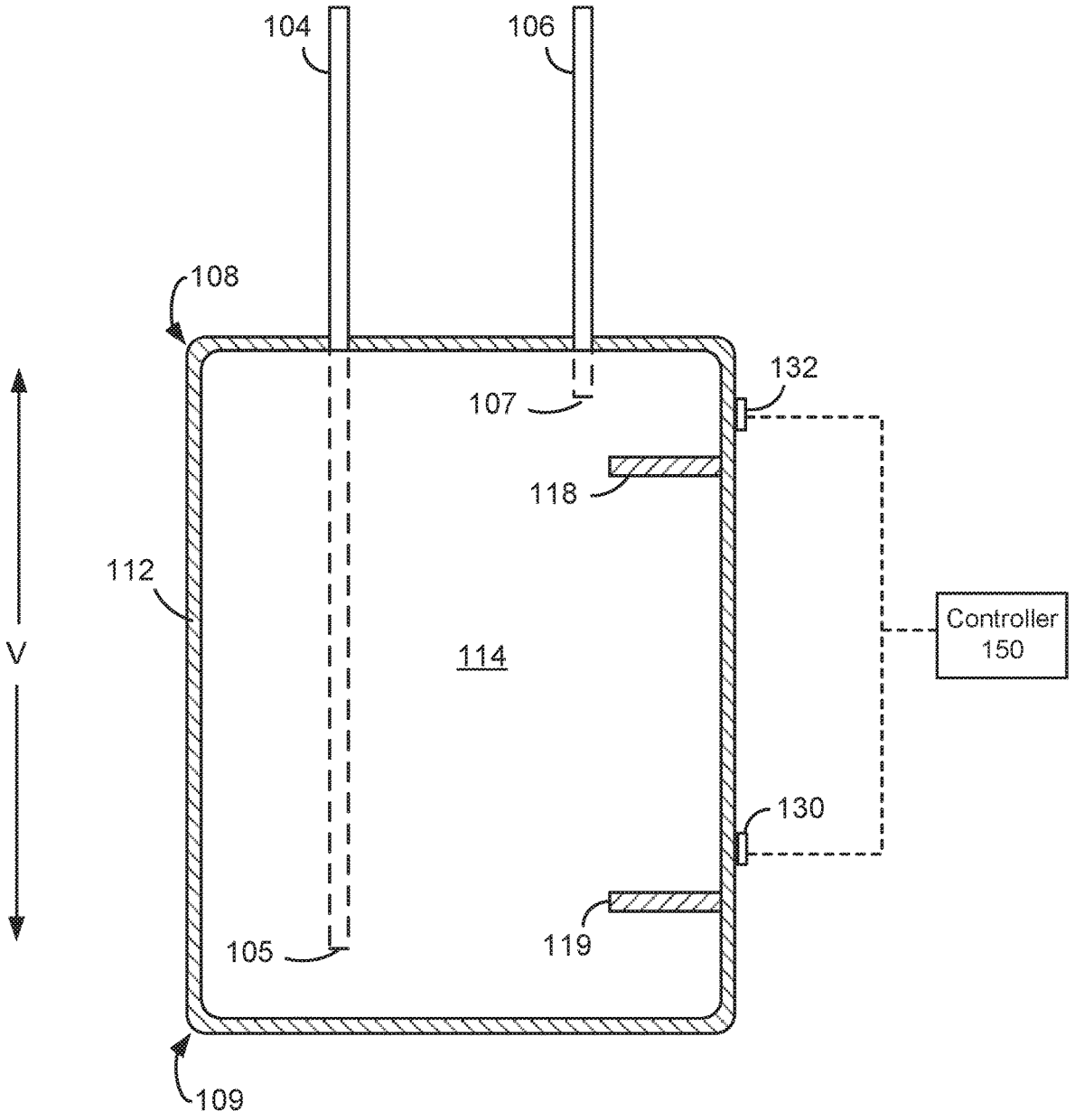
FIG. 2 provides a schematic view of certain components of the exemplary water heater appliance of FIG. 1.

FIG. 1 provides a perspective view of a water heater appliance 100 according to an exemplary embodiment of the present subject matter. FIG. 2 provides a schematic view of certain components of water heater appliance 100. Water heater appliance 100 includes a casing 102. A tank 112 (FIG. 2) is mounted within casing 102. Tank 112 defines an interior volume 114 for heating water therein.

As may be seen in FIGS. 1 and 2, tank 112 of the water heater appliance 100 extends between a top portion 108 and a bottom portion 109 along a vertical direction V. Thus, water heater appliance 100 is generally vertically oriented. Water heater appliance 100 can be leveled, e.g., such that casing 102 is plumb in the vertical direction V, in order to facilitate proper operation of water heater appliance 100.

Water heater appliance 100 also includes a cold water conduit 104 and a hot water conduit 106 that are both in fluid communication with tank 112 within casing 102. As an example, cold water from a water source, e.g., a municipal water supply or a well, enters water heater appliance 100 through cold water conduit 104 at an outlet 105 of the cold water conduit 104. From cold water conduit 104, such cold water enters interior volume 114 of tank 112 wherein the water is heated to generate heated water. Such heated water exits water heater appliance 100 at inlet 107 of hot water conduit 106 and, e.g., is supplied to a bath, shower, sink, or any other suitable feature. Further, as can be seen in FIG. 2, the outlet 105 of the cold water conduit 104 is located proximate the bottom portion 109 and the inlet 107 of the hot water conduit 106 is located proximate the top portion 108. As such, water drawn from the tank 112 via the hot water conduit 106 will be drawn from the hottest portion of the tank.

A drain pan 110 is positioned at bottom portion 109 such that water heater appliance 100 sits on drain pan 110. Drain pan 110 sits beneath water heater appliance 100 along the vertical direction V, e.g., to collect water that leaks from water heater appliance 100. It should be understood that water heater appliance 100 is provided by way of example only and that the present subject matter may be used with any suitable water heater appliance.

Turning now to FIG. 2, water heater appliance 100 includes an upper heating element 118 and a lower heating element 119 for heating water within interior volume 114 of tank 112. Upper and lower heating elements 118 and 119 can be any suitable heating elements. For example, upper heating element 118 and/or lower heating element 119 may be an electric resistance element, a microwave element, an induction element, or any other suitable heating element or combination thereof. Lower heating element 119 may also be a gas burner.

Water heater appliance 100 also includes a first temperature sensor 130 and a second temperature sensor 132. First temperature sensor 130 is configured for measuring a temperature of water within interior volume 114 of tank 112 proximate the lower heating element 119 and second temperature sensor 132 is configured for measuring a temperature of water within interior volume 114 of tank 112 proximate the upper heating element 118. The first and second temperature sensors 130 and 132 can be positioned at any suitable location, e.g., within or on water heater appliance 100. Generally, the first and second temperature sensors 130 and 132 are located above the corresponding heating elements along the vertical direction V, such that water temperatures above each respective heating element may be sensed. For example, first and second temperature sensors 130 and 132 may be positioned within interior volume 114 of tank 112 or may be mounted to tank 112 outside of interior volume 114 of tank 112. When mounted to tank 112 outside of interior volume 114 of tank 112, first and second temperature sensors 130 and 132 can be configured for indirectly measuring the temperature of water within interior volume 114 of tank 112. For example, first and second temperature sensors 130 and 132 can measure the temperature of tank 112 and correlate the temperature of tank 112 to the temperature of water within interior volume 114 of tank 112. The first and second temperature sensors 130 and 132 can be any suitable temperature sensor. For example, first and second temperature sensors 130 and 132 may each be a thermocouple or a thermistor.

As may be seen in FIG. 2, in this context, the first temperature sensor 130 is closer to the inflow of cold water from the outlet 105 of the cold water conduit 104 and the second temperature sensor 132 is closer to the outflow of heated water via the inlet 107 of the hot water conduit 106. Thus, the first temperature sensor 130 is upstream of the second temperature sensor 132 with respect to the flow of water through the water heater appliance 100, e.g., the flow of cold water into the tank 112 and of heated water out of the tank 112.

Water heater appliance 100 further includes a controller 150 that is configured for regulating operation of water heater appliance 100. Controller 150 is in, e.g., operative, communication with upper and lower heating elements 118 and 119 and the first and second temperature sensors 130 and 132. Thus, controller 150 may selectively activate one of the upper and lower heating elements 118 and 119 in order to heat water within interior volume 114 of tank 112, e.g., in response to signals from temperature sensors 130 and/or 132.

Controller 150 includes memory and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 150 may operate upper heating element 118 and/or lower heating element 119 in order to heat water within interior volume 114 of tank 112. As an example, a user may select or establish a set temperature, for water within interior volume 114 of tank 112, or the set temperature for water within interior volume 114 of tank 112 may be a default value. Based upon the set temperature for water within interior volume 114 of tank 112, controller 150 may selectively activate upper heating element 118 and/or lower heating element 119 in order to heat water within interior volume 114 of tank 112 to the set temperature for water within interior volume 114 of tank 112. The set temperature for water within interior volume 114 of tank 112 may be any suitable temperature. For example, the set temperature for water within interior volume 114 of tank 112 may be between about one hundred degrees Fahrenheit (100° F.) and about one hundred and eighty-degrees Fahrenheit (180° F.).

Figure 3:
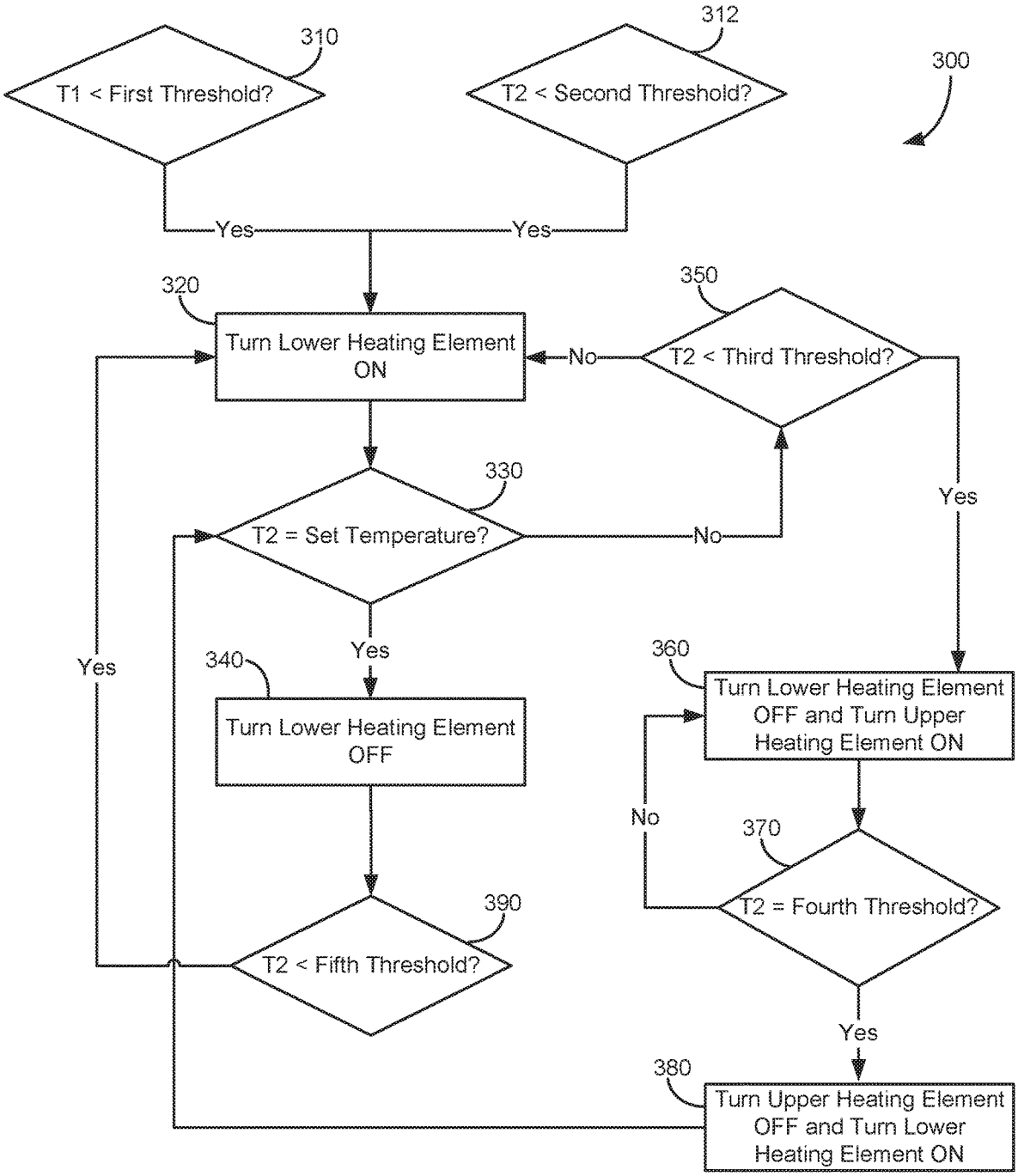
FIG. 3 illustrates a method for operating a water heater appliance according to an exemplary embodiment of the present subject matter.

FIG. 3 illustrates a method 300 for operating a water heater appliance according to an exemplary embodiment of the present subject matter. Method 300 can be used to operate any suitable water heater appliance. For example, method 300 may be used to operate water heater appliance 100 (FIG. 1). Controller 150 may be programmed or configured to implement method 300. Utilizing method 300, heat stacking, e.g., as a result of a succession of draws from water heater appliance 100, may be limited or prevented, e.g., by controlling activation/deactivation of both the upper heating element 118 and the lower heating element 119 based at least in part on temperature measured by the second temperature sensor 132, as discussed in greater detail below.

Method 300 includes several predetermined variables, e.g., a set temperature, as described above, and several temperature thresholds. These variables may be predetermined, e.g., may be default values programmed into the controller 150 and stored in a memory thereof, or may be adapted during use of the water heater appliance 100. For example, the set temperature may be determined based on a signal received from a user input, e.g., established by a user as described above, and the threshold values may be empirically derived values based on the geometry, e.g., size and shape, of the tank 112, which are programmed into the controller 150 at the time of manufacture. Thus, method 300 may include a preliminary step of determining one or more variables, e.g., a set temperature of the water heater appliance.

At steps 310 and 312, the temperature of water within tank 112 of water heater appliance 100 is measured and compared to predefined thresholds. A first temperature value T1 may be obtained from the first temperature sensor 130 and a second temperature value T2 may be obtained from the second temperature sensor 132. As an example, controller 150 may measure or gauge the temperature of water within tank 112 of water heater appliance 100 with first temperature sensor 130 at step 310 and with second temperature sensor 132 at step 312. Thus, a temperature measurement from first temperature sensor 130 may be received at controller 150 at step 310 and from second temperature sensor 132 at step 312.

The temperature may be monitored with the temperature sensors 130 and 132, e.g., temperature values may be continuously measured by the temperature sensors 130 and 132 over time. In various exemplary embodiments described herein throughout, the monitored temperature may be measured continuously or repeatedly over a time interval, e.g., every second, every three seconds, or multiple times per second, etc. Thus, it should be understood that "monitored," "monitoring," or other cognates thereof as used herein include continuous or repeated measuring or sampling of data, e.g., temperature, over a period of time.

When the monitored temperature T1 proximate the lower heating element 119 is less than a first temperature threshold at 310 and the monitored temperature T2 proximate the upper heating element 118 is less than a second temperature threshold at 312, the method 300 may then proceed to a step 320 of turning the lower heating element 119 on, which may also be referred to as activating the lower heating element 119 or cut-in of the lower heating element 119. Notably, step 320 is only performed when both conditions are satisfied, e.g., the lower heating element 119 is activated at step 320 based on the temperature measured with both of the first temperature sensor 130 and the second temperature sensor 132.

The first temperature threshold is generally tank-dependent, e.g., is based on the geometry of the tank, and may be an empirically derived and predetermined value, as described above. The first temperature threshold is less than the set temperature, and will generally be significantly less than the set temperature. For example, as noted above, the set temperature may be about one hundred and twenty degrees Fahrenheit (120° F.), or about one hundred and forty degrees Fahrenheit (140° F.), or more, such as about one hundred and eighty degrees Fahrenheit (180° F.), whereas the first temperature threshold may be between about seventy-five degrees Fahrenheit (75° F.) and about one hundred degrees Fahrenheit (100° F.), such as about ninety degrees Fahrenheit (90° F.).

The second temperature threshold may be defined or determined with reference to the set temperature. For example, the second temperature threshold may be equal to the set temperature minus an offset. In various embodiments, the offset of the second temperature threshold may be between about one-quarter degree Fahrenheit (0.25° F.) and about one and a half degrees Fahrenheit (1.5° F.), such as about one-half degree Fahrenheit (0.5° F.).

At step 330, controller 150 determines whether the temperature measurement T2 from second temperature sensor 132 is equal to the set temperature for water heater appliance 100. If the temperature measurement from the second temperature sensor 132 is not equal to the set temperature for water heater appliance 100, controller 150 continues to monitor the temperature of water within interior volume 114 of tank 112 with temperature sensors 130 and 132. When the monitored temperature T2 proximate the upper heating element 118 is equal to the set temperature, the method 300 then proceeds to step 340 of turning the lower heating element 119 off, which may also be referred to as deactivating the lower heating element 119 or cut-out of the lower heating element 119. Notably, in such embodiments, the lower heating element 119 may be deactivated based on the monitored temperature T2 proximate the upper heating element 118 measured by the second temperature sensor 132.

In some embodiments, the method 300 may also include, after activating the lower heating element 119 at step 320 and when the monitored temperature T2 proximate the upper heating element 118 is not equal to (e.g., is less than) the set temperature, a step 350 of comparing the monitored temperature T2 proximate the upper heating element 118 to a third temperature threshold. When the monitored temperature T2 proximate the upper heating element 118 is less than the third temperature threshold, method 300 may proceed to a step 360 of turning the lower heating element 119 off and turning the upper element 118 on.

In some embodiments, the third temperature threshold may be an absolute temperature threshold, e.g., a fixed value independent of the set temperature. For example, the third temperature threshold may be between about ninety degrees Fahrenheit (90° F.) and about one hundred and twenty degrees Fahrenheit (120° F.), such as about one hundred and five degrees Fahrenheit (105° F.).

In other embodiments, the third temperature threshold may be an offset or delta temperature from a maximum of the monitored temperature T2 proximate the upper heating element 118. For example, the third temperature threshold may be determined by subtracting a draw factor from the maximum of the monitored temperature T2. For example, the maximum of T2 may be defined within a moving time window, such as about one hour, wherein the maximum of T2 may be an hourly maximum. In additional embodiments, the maximum of T2 may be defined within a shorter time window, e.g., about a half hour, or a longer time window, e.g., about one and a half hours or about two hours, etc. In some embodiments, the draw factor may be an empirically-derived value based on the tank geometry. For example, the draw factor may be between about two degrees Fahrenheit (2° F.) and about six degrees Fahrenheit (6° F.), such as about three degrees Fahrenheit (3° F.).

The temperature T2 dropping below the third threshold may indicate a sustained draw from the water heater appliance 100, such that more rapid heating of water closer to the top portion 108 of the tank 112, near the inlet 107 of the hot water conduit 106, e.g., with the upper heating element 118, may be desired. For example, the draw factor may be based on the geometry of the tank 112 and may represent consumption of between about forty percent (40%) and about sixty percent (60%), such as about fifty percent (50%), of the volume capacity of the tank 112.

After first turning the lower element 119 off and then turning the upper element 118 on at step 360, the controller 150 may continue to monitor the temperature within the tank 112, such as at least the temperature T2 proximate the upper heating element 118. Thus, the method 300 may include a further step 370 of determining whether the monitored temperature T2 proximate the upper heating element 118 is equal to a fourth temperature threshold. When the monitored temperature T2 proximate the upper heating element 118 is equal to the fourth temperature threshold, the method 300 may proceed to a step 380 of turning the upper element 118 off and turning the lower element 119 on. The lower element 119 may be continuously activated until the monitored temperature T2 proximate the upper heating element 118 is equal to the set temperature. The fourth temperature threshold may be equal to the set temperature minus a lag factor. For example, embodiments wherein the second temperature sensor 132 is positioned outside the tank 112 may include a thermal lag. The thermal lag may represent the time it takes for heat from the water in the internal volume 114 to travel through the wall of the tank 112 and reach the second temperature sensor 132. Thus, incorporating the lag factor into the fourth temperature threshold may advantageously provide a closer approximation of the set temperature within the tank, in that deactivating the upper heating element 118 short of the set temperature allows the temperature sensed by the second temperature sensor 132 to catch up to the temperature of the water within the tank 112.

After turning the lower heating element 119 off at step 340, the controller 150 may continue to monitor the temperature within the tank 112. Additionally, in some embodiments, the method 300 may include a step 390 of determining whether the monitored temperature T2 proximate the upper heating element 118 is less than a fifth temperature threshold after turning the lower heating element 119. In such embodiments, the method 300 may further include turning the lower heating element 119 back on (e.g., returning to step 320, as shown in FIG. 3) when the monitored temperature T2 proximate the upper heating element 118 is less than the fifth temperature threshold. For example, the fifth temperature threshold may be equal to the set temperature minus a standby factor. For example, the standby factor may be between about three degrees Fahrenheit (3° F.) and about eight degrees Fahrenheit (8° F.), such as about five degrees Fahrenheit (5° F.). The standby factor may be indicative of a standby condition, wherein heat dissipates from the water within the tank 112 over an extended storage period. The standby condition of water heater appliance 100 may correspond to time periods, such as nighttime or working hours, when a building housing water heater appliance 100 is empty or occupants of the building are not utilizing heated water from water heater appliance 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a water heater appliance, comprising:

determining a set temperature of the water heater appliance;

monitoring a temperature proximate to a lower heating element of the water heater appliance with a first temperature sensor of the water heater appliance;

monitoring a temperature proximate to an upper heating element of the water heater appliance with a second temperature sensor of the water heater appliance;

turning the lower heating element on when the monitored temperature proximate the lower heating element is less than a first temperature threshold and the monitored temperature proximate the upper heating element is less than a second temperature threshold;

turning the lower heating element off when the monitored temperature proximate the upper heating element is equal to the set temperature; and turning the upper element on when the monitored temperature proximate the upper heating element is less than a third temperature threshold, wherein the third temperature threshold is equal to a maximum of the monitored temperature proximate the upper heating element minus a draw factor.

2. The method of claim 1, wherein the second temperature threshold is equal to the set temperature minus an offset.

3. The method of claim 1, wherein the third temperature threshold is a fixed value independent of the set temperature.

4. The method of claim 1, further comprising turning the upper element off when the monitored temperature proximate the upper heating element is equal to a fourth temperature threshold.

5. The method of claim 4, further comprising turning the lower heating element on after turning the upper heating element off, and turning the lower heating element off when the monitored temperature proximate the upper heating element is equal to the set temperature.

6. The method of claim 4, wherein the fourth temperature threshold is equal to the set temperature minus a lag factor.

7. The method of claim 1, further comprising turning the lower heating element on after turning the lower heating element off when the monitored temperature proximate the upper heating element is less than a fifth temperature threshold.

8. The method of claim 7, wherein the fifth temperature threshold is equal to the set temperature minus a standby factor.

9. A water heater appliance, comprising:

a tank extending between a top portion and a bottom portion along a vertical direction, the tank defining an interior volume;

an upper heating element positioned within the interior volume of the tank proximate the top portion of the tank;

a lower heating element positioned within the interior volume of the tank proximate the bottom portion of the tank;

a first temperature sensor positioned proximate the lower heating element and configured for measuring a temperature of water within the interior volume of the tank proximate the lower heating element;

a second temperature sensor positioned proximate the upper heating element and configured for measuring a temperature of water within the interior volume of the tank proximate the upper heating element; and a controller in operative communication with the upper heating element, the lower heating element, the first temperature sensor, and the second temperature sensor, the controller configured for:

monitoring the temperature proximate to the lower heating element of the water heater appliance with the first temperature sensor;

monitoring the temperature proximate to the upper heating element of the water heater appliance with the second temperature sensor;

turning the lower heating element on when the monitored temperature proximate the lower heating element is less than a first temperature threshold and the monitored temperature proximate the upper heating element is less than a second temperature threshold;

turning the lower heating element off when the monitored temperature proximate the upper heating element is equal to the set temperature;

turning the upper element on when the monitored temperature proximate the upper heating element is less than a third temperature threshold; and turning the upper element off when the monitored temperature proximate the upper heating element is equal to a fourth temperature threshold, wherein the fourth temperature threshold is equal to the set temperature minus a lag factor.

10. The water heater appliance of claim 9, wherein the second temperature threshold is equal to the set temperature minus an offset.

11. The water heater appliance of claim 9, wherein the third temperature threshold is a fixed value independent of the set temperature.

12. The water heater appliance of claim 9, wherein the third temperature threshold is equal to a maximum of the monitored temperature proximate the upper heating element minus a draw factor.

13. The water heater appliance of claim 9, wherein the controller is further configured for turning the lower heating element on after turning the upper heating element off, and turning the lower heating element off when the monitored temperature proximate the upper heating element is equal to the set temperature.

14. The water heater appliance of claim 9, wherein the controller is further configured for turning the lower heating element on after turning the lower heating element off when the monitored temperature proximate the upper heating element is less than a fifth temperature threshold.

15. The water heater appliance of claim 14, wherein the fifth temperature threshold is equal to the set temperature minus a standby factor.

* * * * *